US009174439B2

(12) United States Patent
Ibe et al.

(10) Patent No.: US 9,174,439 B2
(45) Date of Patent: Nov. 3, 2015

(54) LIQUID EJECTION HEAD AND METHOD FOR MANUFACTURING LIQUID EJECTION HEAD

(71) Applicant: CANON KABUSHIKI KAISHA, Tokyo (JP)

(72) Inventors: Satoshi Ibe, Yokohama (JP); Yoshinori Tagawa, Yokohama (JP); Jun Yamamuro, Yokohama (JP); Hiroto Komiyama, Tokyo (JP); Kouji Hasegawa, Kawasaki (JP); Shiro Sujaku, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/956,737

(22) Filed: Aug. 1, 2013

(65) Prior Publication Data

US 2014/0035999 A1 Feb. 6, 2014

(30) Foreign Application Priority Data

Aug. 6, 2012 (JP) ..... 2012-173756

(51) Int. Cl.
*B41J 2/16* (2006.01)
*B41J 2/14* (2006.01)

(52) U.S. Cl.
CPC ..... *B41J 2/14* (2013.01); *B41J 2/14072* (2013.01); *B41J 2/1603* (2013.01); *B41J 2/1621* (2013.01); *B41J 2/1631* (2013.01); *B41J 2/1643* (2013.01)

(58) Field of Classification Search
CPC ..... B41J 2002/14491; B41J 2/14072; H01L 2924/01079
USPC ..... 347/50; 257/687, 692, 710, 711
See application file for complete search history.

(56) References Cited

U.S. PATENT DOCUMENTS

| | | | | |
|---|---|---|---|---|
| 5,034,345 | A * | 7/1991 | Shirahata | 438/613 |
| 6,426,556 | B1 * | 7/2002 | Lin | 257/738 |
| 7,816,780 | B2 * | 10/2010 | Kajiwara et al. | 257/692 |
| 8,421,208 | B2 * | 4/2013 | Takemura | 257/692 |
| 2002/0053734 | A1 * | 5/2002 | Eldridge et al. | 257/724 |
| 2004/0178491 | A1 * | 9/2004 | Akram et al. | 257/686 |
| 2006/0170734 | A1 * | 8/2006 | Ibe et al. | 347/58 |
| 2007/0211115 | A1 * | 9/2007 | Ibe et al. | 347/58 |
| 2010/0164079 | A1 * | 7/2010 | Dekker et al. | 257/676 |
| 2010/0201757 | A1 * | 8/2010 | Shimada et al. | 347/71 |
| 2011/0309505 | A1 * | 12/2011 | Takemura | 257/738 |
| 2012/0091576 | A1 * | 4/2012 | Tsai et al. | 257/737 |

FOREIGN PATENT DOCUMENTS

JP 2007-307833 A 11/2007

* cited by examiner

*Primary Examiner* — Matthew Luu
*Assistant Examiner* — Patrick King
(74) *Attorney, Agent, or Firm* — Canon USA Inc. IP Division

(57) ABSTRACT

A liquid ejection head includes a print element board and an electric wiring board electrically connected to a bump of the print element board using an interconnecting wire. The bump has a first surface and a second surface. The height of the second surface from a surface of a base plate is higher than that of the first surface. The first surface has a protrusion formed therein, and the bump is connected to the interconnecting wire in the second surface.

7 Claims, 4 Drawing Sheets

LIQUID EJECTION HEAD AND METHOD FOR MANUFACTURING LIQUID EJECTION HEAD

BACKGROUND

1. Field

Aspects of the present invention generally relate to a liquid ejection head and a method for manufacturing a liquid ejection head.

2. Description of the Related Art

A liquid ejection head used in, for example, ink jet printing apparatuses includes a print element board and an electric wiring board. FIG. 2A illustrates a print element board of a liquid ejection head. The print element board includes a base plate 1 and an energy generating device 15 that generates energy for ejecting droplets of liquid. The base plate 1 has a supply port 11 formed therein. The supply port 11 supplies liquid to the energy generating device 15. In addition, the base plate 1 includes an ejection port forming member 12 for forming an ejection port 13. The ejection port 13 ejects droplets of the supplied liquid.

As described in Japanese Patent Laid-Open No. 2007-307833, electric power is supplied from an external electric wiring board to the energy generating device 15 using an electrode pad (not illustrated) of the print element board and a bump 7 formed on the electrode pad. The electrode pad is electrically connected to the energy generating device. Electric power is supplied from the electric wiring board by connecting the bump 7 to the electric wiring board using an interconnecting wire.

For example, the bump 7 is formed by plating, such as gold plating. FIG. 2B is a cross-sectional view taken along a line IIB-IIB of FIG. 2A, that is, an enlarged view of the bump formed by plating. The bump 7 is formed on an electrode pad 3 made of, for example, aluminum. An insulation layer 2 made of, for example, $SiO_2$ is disposed between the base plate 1 and the electrode pad 3. The electrode pad 3 is disposed between protective layers 4 made of P—SiN. In order to increase adhesiveness between the electrode pad 3 and the bump 7 and prevent a decrease in connection reliability caused by mutual metal diffusion, a diffusion prevention layer 5 is formed between the electrode pad 3 and the bump 7.

SUMMARY

According to an exemplary embodiment, a liquid ejection head includes a print element board and an electric wiring board. The print element board includes a base plate, an energy generating device configured to generate energy for ejecting liquid, an electrode pad electrically connected to the energy generating device, and a bump formed on the electrode pad. The electric wiring board is electrically connected to the bump of the print element board using an interconnecting wire. The bump has a first surface and a second surface, where a height of the second surface from a surface of the base plate is higher than that of the first surface, the first surface has a protrusion formed therein, and the bump is connected to the interconnecting wire in the second surface.

Further features of the present disclosure will become apparent from the following description of exemplary embodiments with reference to the attached drawings.

DESCRIPTION OF THE EMBODIMENTS

Figure 2A:
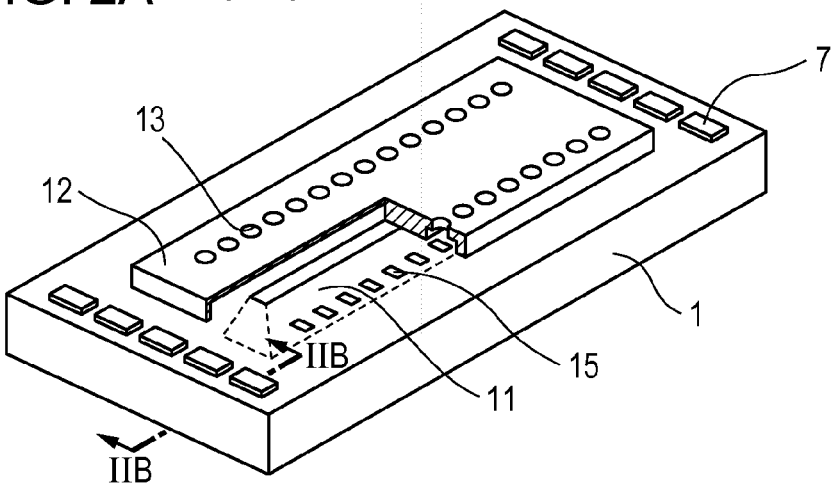
FIG. 2A Prior Art
FIGS. 2A to 2C illustrate an example of an existing liquid ejection head.
Figure 2B:
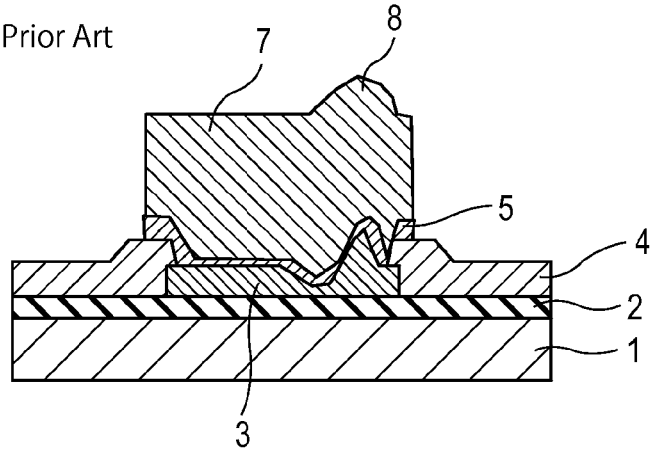
FIG. 2B Prior Art

As illustrated in FIG. 2B, the bump 7 may have a protrusion 8. In particular, when the bump 7 is formed by plating, the protrusion 8 is easily formed. The following description is made with reference to an electrode pad made of, for example, aluminum. The electrode pad needs to be electrically connected to an energy generating device. Accordingly, by electrically inspecting the electrode pad, an electrical connection condition of the energy generating device can be inspected. In electrical connection inspection, a probe card having pin structures, such as probe pins, arranged therein is stuck into the electrode pad so that a natural oxide film naturally formed on a surface of the electrode pad is broken. Thereafter, by applying an electric current to the probe card, the electric resistance can be measured. At that time, the probe pin slides along the surface of the electrode pad and gets stuck deep in the electrode pad. Accordingly, the probe pin generates a scraped portion (a recess) of the electrode pad and a protrusion formed by the scraped portion (an electrical inspection mark) on the surface of the electrode pad. If the electrode pad having such a protrusion is plated to form a bump, a protrusion having the same shape as the protrusion formed on the electrode pad is also formed on the surface of the bump. In addition, a recess is formed on the surface of the bump. Note that the depth of the recess formed on the surface of the bump is not greater than or equal to the thickness of the electrode pad. Thus, the depth of the recess formed on the surface of the bump is less than or equal to about 0.5 μm, although depending on the thickness of the electrode pad. In contrast, the protrusion formed on the surface of the bump is generally higher than or equal to 5.0 μm, although depending on the sliding distance of the probe pin.

Figure 2C:
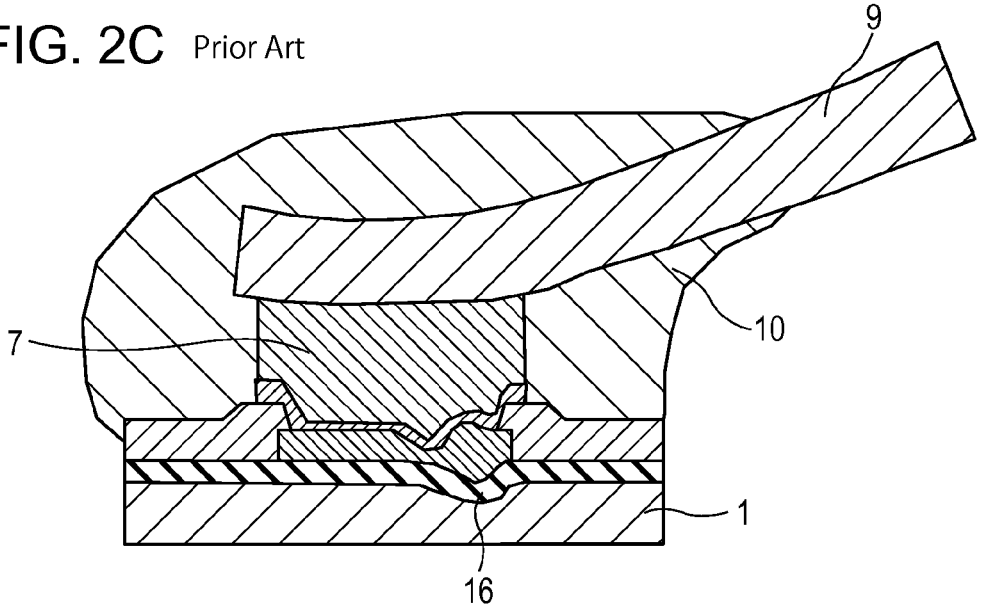
FIG. 2C Prior Art

As illustrated in FIG. 2C, an interconnecting wire 9, such as an inner lead, is connected to the bump. The connecting portion is sealed with a sealing member 10. For example, if a gang bonding method is employed in order to connect interconnecting wires to bump arrays, all at the same time, a pressure of about 2 N is applied onto each of the bumps. At that time, if the bump 7 has a protrusion formed thereon, the interconnecting wire pushes the protrusion into the base plate 1. Thus, the pressure is concentrated on the base plate 1 and, therefore, cracking 16 may occur in the base plate 1. It is difficult to detect the cracking 16 of the base plate 1 using electrical inspection. Accordingly, after the head is produced, the bump or the interconnecting wire may come off through the cracking 16 due to difference in thermal expansion caused by accumulated heat.

Figure 3A:
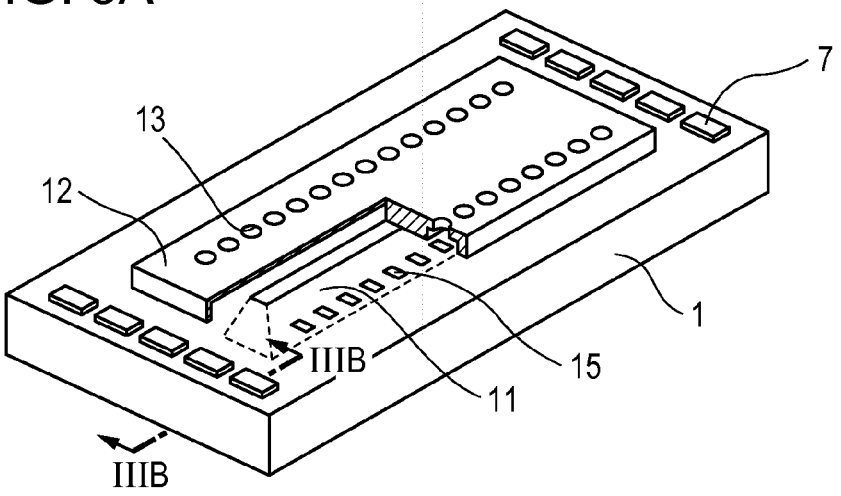
FIG. 3A Prior Art
FIGS. 3A to 3C illustrate an example of an existing liquid ejection head.
Figure 3B:
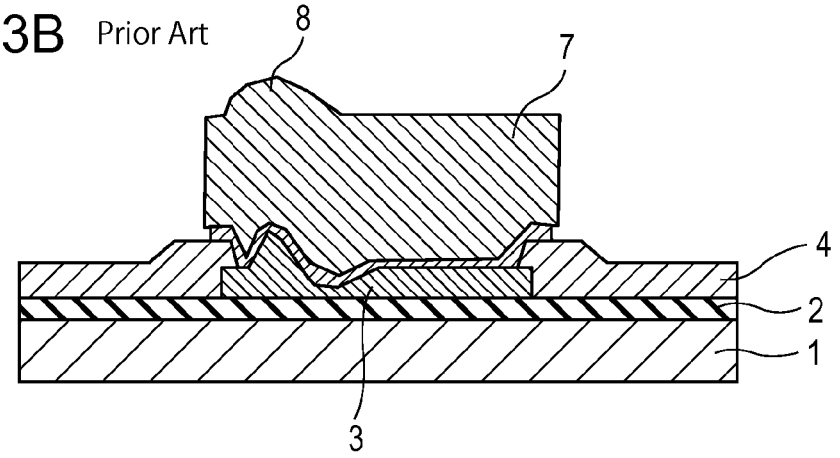
FIG. 3B Prior Art
Figure 3C:
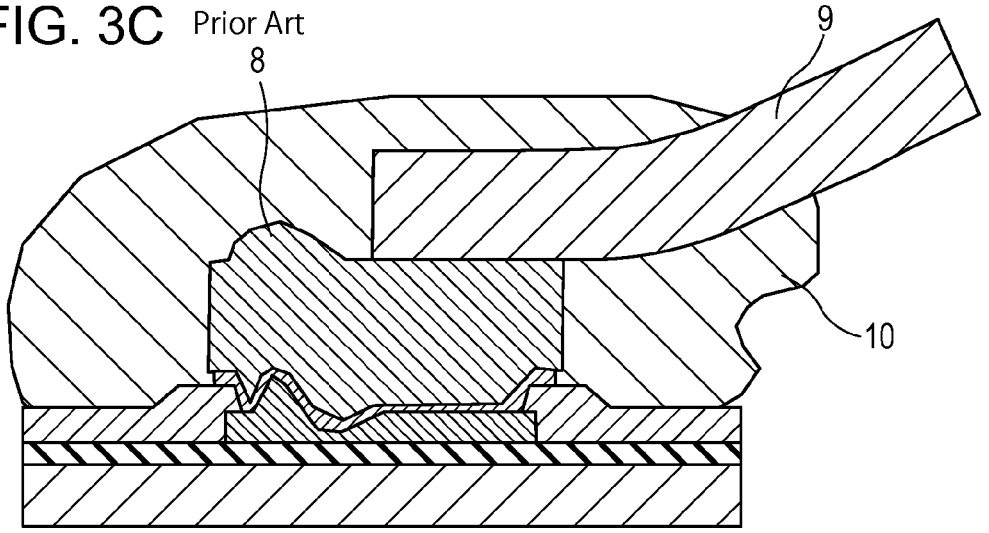
FIG. 3C Prior Art

To solve such a problem, as illustrated in FIG. 3B, the areas of the electrode pad and the bump can be increased. Thereafter, by partitioning the area into an area to be subjected to electrical inspection and an area to which an interconnecting wire is connected, the interconnecting wire 9 can be disposed while avoiding the protrusion 8. FIG. 3B is a cross-sectional view taken along a line IIIB-IIIB of FIG. 3A.

However, according to such a technique, a highly advanced technique is required to align the protrusion 8 of the bump with the interconnecting wire 9. Even when slight misalignment occurs and, thus, the interconnecting wire 9 is disposed on the protrusion 8, cracking may occur in the base plate. In addition, if the areas of the electrode pad and the bump are further increased in order to reliably partition the areas into an area to be subjected to electrical inspection and an area to which an interconnecting wire is connected, the size of a single print element board increases and, in turn, the number of print element boards obtained from a single wafer is reduced.

As described above, when a bump has a protrusion formed thereon and if an interconnecting wire is disposed on the bump, cracking may occur in the base plate. In some cases, a protrusion is formed on a bump in a manufacturing phase, without performing electrical inspection on the electrode pad. In addition, in some cases, a protrusion is formed on a bump that is not generated by plating. In such cases, the same problem occurs.

Accordingly, the present disclosure provides a liquid ejection head having a high reliability even when a protrusion is formed on a bump of the print element board and an interconnecting wire is connected onto the bump.

Figure 1A:
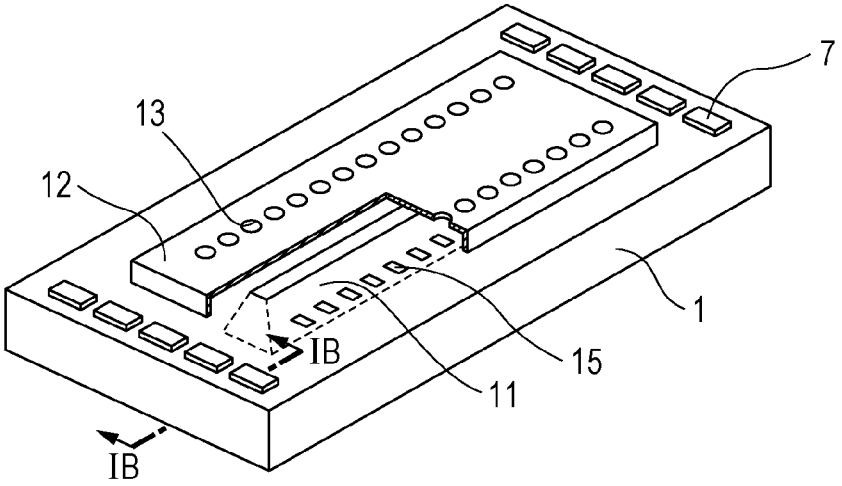
FIGS. 1A to 1C illustrate an example of a liquid ejection head according to an exemplary embodiment.

FIG. 1A illustrates an example of a print element board that constitutes the liquid ejection head according to the present exemplary embodiment. The print element board includes a base plate 1 and an energy generating device 15 that generates energy for ejecting droplets of liquid. The base plate 1 is made of, for example, silicon. The base plate 1 has a supply port 11 formed therein. The supply port 11 supplies liquid to the energy generating device 15. The supply port 11 is formed by emitting a laser beam onto the base plate 1, performing anisotropic etching on the base plate 1 using, for example, TMAH, or performing dry etching on the base plate 1. In addition, the base plate 1 includes an ejection port forming member 12 for forming an ejection port 13. The ejection port 13 ejects droplets of liquid supplied from the supply port 11. The ejection port forming member 12 is made of, for example, resin (in particular, photosensitive resin) or an inorganic film.

The energy generating device 15 may be a device that is formed of TaSiN and that generates thermal energy or a piezoelectric device. In addition, the energy generating device 15 may be formed directly on the base plate 1 or may be formed so as to have a hollow portion between the base plate 1 and the energy generating device 15. Electric power is supplied from an external electric wiring board to the energy generating device 15 through an electrode pad (not illustrated) of the print element board and a bump 7 formed on the electrode pad. The electric power is supplied from the electric wiring board by connecting the bump 7 to the electric wiring board using an interconnecting wire.

Figure 1B:
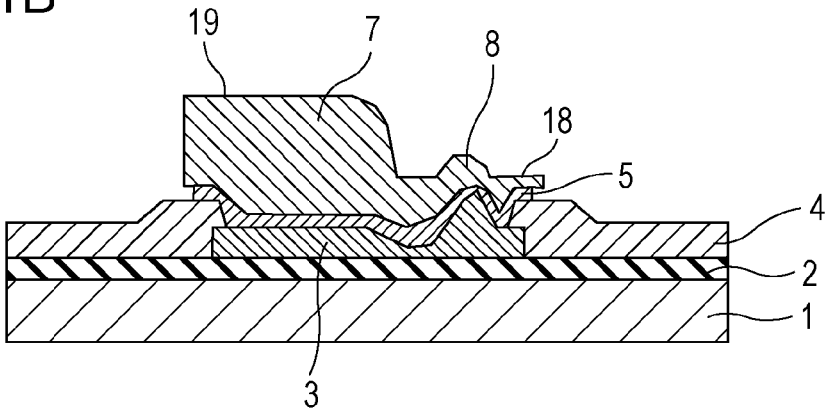
Figure 1C:
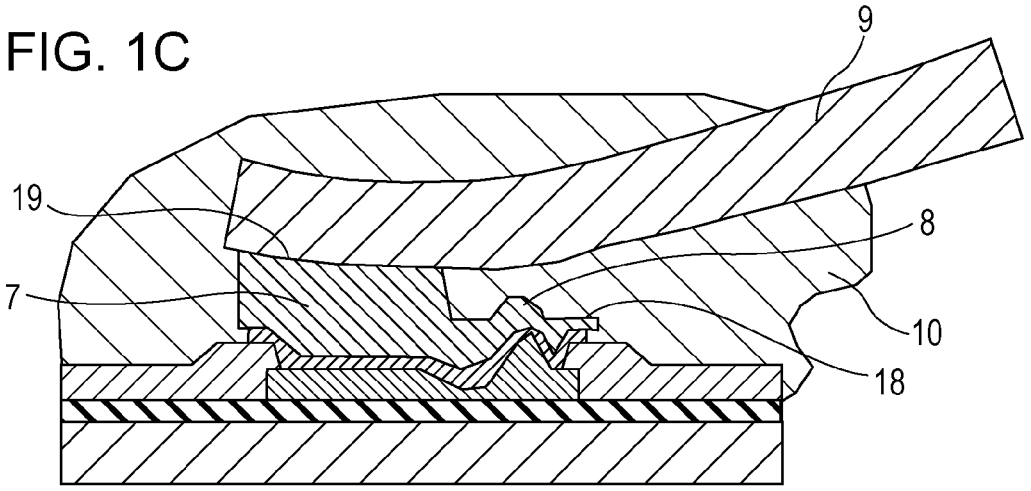

FIG. 1B is a cross-sectional view taken along a line IB-IB of FIG. 1A, that is, an enlarged view of the bump 7 and its vicinity. In the vicinity of the bump 7, an insulation layer 2 made of, for example, $SiO_2$ is disposed on top of the base plate 1. An electrode pad 3 made of, for example, aluminum is formed on top of the insulation layer 2. The electrode pad 3 is disposed between protective layers 4 made of, for example, P—SiN. The electrode pad 3 has a diffusion prevention layer 5 formed thereon. The bump 7 is formed on the diffusion prevention layer 5 by plating. The bump 7 has a first surface 18 and a second surface 19. The first surface 18 and the second surface 19 are substantially parallel to the surface of the base plate. The height of the second surface 19 from the surface of the base plate 1 is greater than that of the first surface 18. The first surface 18 has a protrusion 8 formed thereon. The second surface 19 of the bump 7 is connected to an interconnecting wire, such as an inner lead. The print element board is electrically connected to the electric wiring board via the interconnecting wire. FIG. 1C illustrates the second surface 19 of the bump 7 connected to an interconnecting wire 9. It is desirable that the connecting portion be surrounded and sealed by a sealing member 10. In addition, as illustrated in FIG. 1C, a protrusion is formed on a surface of the electrode pad 3 at a position corresponding to the protrusion 8 formed on the first surface 18 of the bump 7.

Since the liquid ejection head according to the present exemplary embodiment has such a structure, contact of the protrusion 8 with the interconnecting wire 9 can be easily avoided. By setting the position of the upper surface of the protrusion 8 to lower than the interconnecting wire 9, the protrusion 8 is not in contact with the interconnecting wire 9 even when the bump 7 is in contact with the interconnecting wire 9. That is, a difference in height between the second surface 19 and the first surface 18 is larger than the height of the protrusion 8. In such a case, pressure applied from the interconnecting wire 9 is not transferred to the base plate 1 via the protrusion 8. Alternatively, if the upper surface of the protrusion 8 is in slight contact with the interconnecting wire 9, pressure applied from the interconnecting wire 9 is only slightly transferred to the base plate 1 via the protrusion 8.

In this manner, according to the structure of the present exemplary embodiment, the occurrence of the above-described cracking in the base plate 1 can be prevented. In addition, since the protrusion 8 is formed on the first surface 18 located at a lower position of the bump 7, the interconnecting wire 9 can be significantly easily disposed without touching the protrusion 8. That is, it is only required that a plane in which the interconnecting wire 9 is connected to the bump 7 is located at a height that is the same height or higher than the upper surface of the protrusion 8 formed on the bump 7. Furthermore, according to the structure of the present exemplary embodiment, since the protrusion 8 is formed at the lower position, a layout that allows the protrusion 8 to be located under the interconnecting wire 9 is available. Thus, the areas of the electrode pad 3 and the bump 7 need not be increased. For these reasons, the number of print element boards obtained from a single wafer need not be reduced.

A method for manufacturing the liquid ejection head according to the present exemplary embodiment is described next with reference to FIGS. 4A to 4L.

Figure 4A:
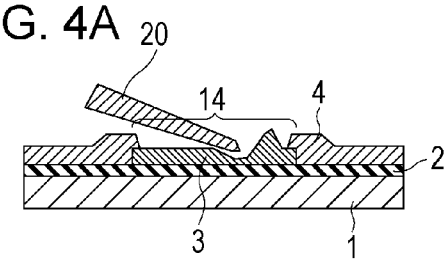
FIGS. 4A to 4L illustrate an example of a method for manufacturing an existing liquid ejection head according to the present exemplary embodiment.

The base plate 1 made of, for example, silicon is prepared first. The base plate 1 has the insulation layer 2 on the front surface thereof. The insulation layer 2 is made of, for example, $SiO_2$. The electrode pad 3 and the protective layer 4 that surrounds the electrode pad 3 are disposed on the insulation layer 2. The electrode pad 3 is made of, for example, aluminum. The protective layer 4 is made of, for example, P—SiN. The electrode pad 3 and the protective layer 4 are formed using, for example, a vacuum film forming method. A through-hole 14 is formed by patterning the protective layer 4 using, for example, a photolithography technique. Subsequently, a probe card having probe pins 20 arranged thereon is stuck into the electrode pad so as to break a natural oxide film naturally formed on the surface of the electrode pad 3. Thereafter, an electric current is applied to the probe card, and the electrical resistance is measured. In this manner, electrical connection with the energy generating device is examined. The probe pins 20 form a pin structure. Thus, as illustrated in FIG. 4A, the probe pins 20 generate a scraped portion (a recess) of the electrode pad 3 and a protrusion formed by the scraped portion (an electrical inspection mark) on the surface of the electrode pad 3. Note that after the bump 7 is formed on the electrode pad 3, electric inspection may be performed on the bump 7. However, in order to increase the manufacturing efficiency, it is desirable that electric inspection be performed before the bump 7 is formed. In addition, it is desirable that the protrusion be formed on the outer side of the center of the bump 7 (the side on which the interconnecting wire extends between the electric wiring board and the print element board, that is, on the right sides of FIGS. 4A to 4L). By forming the protrusion on the outer side of the center, contact of the interconnecting wire with the protrusion can be more reliably prevented.

Figure 4B:
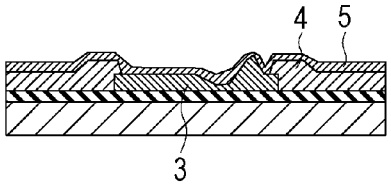

Subsequently, as illustrated in FIG. 4B, the diffusion prevention layer 5 is formed on the surface of the electrode pad 3 using, for example, a vacuum film forming apparatus. The diffusion prevention layer 5 is made of, for example, a metallic material having a high melting point, such as titanium tungsten. The diffusion prevention layer 5 is formed on the electrode pad 3 so as to have the same surface profile as the electrode pad 3. Thus, a recess and a protrusion are also formed in the diffusion prevention layer 5.

Figure 4C:
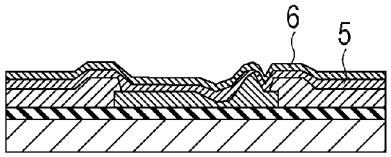

Subsequently, as illustrated in FIG. 4C, a seed layer 6 is formed using an electrolytic plating process. The seed layer 6 serves as a cathode electrode that receives an electric current and also serves as a core of plating growth. For example, to form the seed layer 6, gold having a film thickness of 0.03 to 0.07 μm is coated over the entire surface. Like the diffusion prevention layer 5, the seed layer 6 is formed on the electrode pad 3 so as to have the same surface profile as the electrode pad 3. That is, the seed layer 6 also has a recess and a protrusion.

Figure 4D:
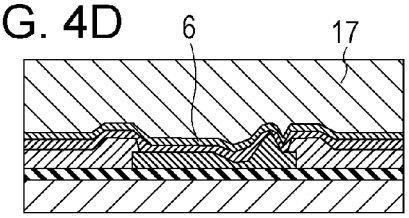

Subsequently, as illustrated in FIG. 4D, a resist 17 is applied to the entire surface of the base plate 1 by using, for example, a spin coat technique. At that time, the resist 17 is formed so as to be higher than a surface of the bump 7 to which an interconnecting wire is connected (i.e., the second surface). For example, a photosensitive resin can be used as the material of the resist 17.

Figure 4E:
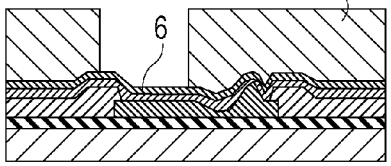

Subsequently, as illustrated in FIG. 4E, first exposure and development are performed on the resist 17 by using a photolithography process. Thus, part of the seed layer 6 on which the bump 7 is to be formed by plating growth is exposed.

Figure 4F:
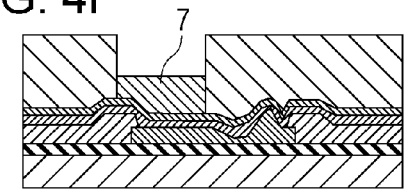

Subsequently, as illustrated in FIG. 4F, by passing a predetermined amount of electrical current through the seed layer 6 dipped in gold sulfite plating solution and precipitating gold in the plating solution over an area that is not covered by the resist 17 using an electrolytic plating process, part of the bump 7 is formed. For example, if the thickness of the part of the bump 7 is set to 4 μm, the plating time is set to 10.5 minutes. The bump 7 formed in this phase serves as part of an interconnecting wire connection area.

Figure 4G:
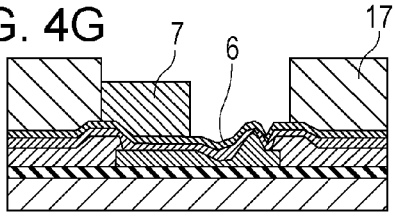

Subsequently, as illustrated in FIG. 4G, second exposure and development are performed on the resist 17 by using a photolithography process. Thus, the seed layer 6 in a protrusion forming area having the protrusion formed therein is exposed.

Figure 4H:
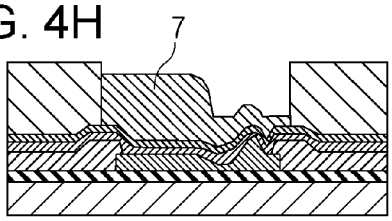

Subsequently, as illustrated in FIG. 4H, the plating is grown using the electrolytic plating process. The plating can be stopped if the seed layer 6 having the protrusion formed thereon is covered by the plating. If this plating is performed, the plating portion previously grown is also further grown. The reason why the plating is grown even in the area having the protrusion formed therein is as follows. That is, if, in the next step in which the seed layer 6 is removed, the electrode pad 3 formed of, for example, aluminum is exposed, the electrode pad 3 corrodes due to galvanic corrosion occurring between different types of metal (i.e., the plating metal (gold) and aluminum) and, thus, the bump 7 falls off from the electrode pad 3. Accordingly, by causing the plating film to function as a protection film, falling off of the bump 7 can be prevented. Through this step, an interconnecting wire connection area and a protrusion forming area of the bump 7 are accomplished. As used herein, the term "interconnecting wire connection area" refers to an area including the area formed by the previous plating and having the second surface of the bump 7. The term "protrusion forming area" refers to an area above the protrusion of the electrode pad 3 formed by the second plating and having the first surface of the bump 7. As described above, a protrusion is formed on the first surface of the bump 7 at a position corresponding to the protrusion on the surface of the electrode pad 3. Conversely, a protrusion is formed on the surface of the electrode pad 3 at a position corresponding to the protrusion on the first surface of the bump 7.

Figure 4I:
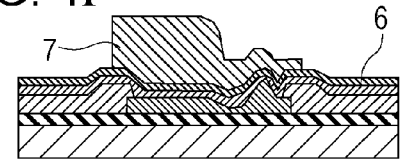
Figure 4J:
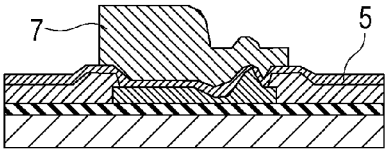

Subsequently, as illustrated in FIG. 4I, the resist 17 is removed using, for example, a solvent. Subsequently, as illustrated in FIG. 4J, the seed layer 6 is removed using the formed bump 7 as a mask. For example, in order to remove the seed layer 6, liquid containing organonitrogen compound and iodine-potassium iodide is used. By removing the seed layer 6, the diffusion prevention layer 5 is exposed. When the film thickness of the seed layer 6 is in the range from 0.03 μm to 0.07 μm and if the seed layer 6 is dipped into etchant to remove the seed layer 6, the bump 7 (the plating metal) having a thickness of about 0.95 μm can still remain in the protrusion forming area. Accordingly, corrosion of the aluminum can be prevented.

Figure 4K:
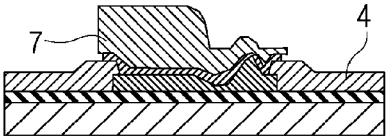

Subsequently, as illustrated in FIG. 4K, by dipping the print element board into the etchant, such as $H_2O_2$, and using the bump 7 as a mask, the diffusion prevention layer 5 that is unnecessary can be removed. In this manner, the electrode pad 3 and the bump 7 of the print element board having the same potential due to the diffusion prevention layer formed on the entire surface are separated from each other.

Subsequently, an annealing process (a heating process) is performed on the bump 7. It is desirable that by performing the annealing process, the hardness of the bump 7 to which an interconnecting wire is to be connected be set to a value lower than or equal to 70 Hv. If the hardness is lower than or equal to 70 Hv, the interconnecting wire can be excellently connected. That is, it is desirable that the hardness of the bump 7 in the interconnecting wire connection area of the second surface of the bump 7 be set to a value lower than or equal to 70 Hv.

In addition, if the bump 7 is formed by the second plating, the hardness of the bump 7 in the interconnecting wire connection area differs from the hardness of the bump 7 in the protrusion forming area. Therefore, the reliability of the bump 7 may be decreased. For example, when gold plating is performed and if the current density of an electric current supplied to the base plate 1 and the plating liquid is set to about 0.6 A/dm$^2$, the hardness of the bump 7 formed is about 120 Hv. In contrast, if the current density is set to about 1.2 A/dm$^2$, the hardness of the bump 7 formed is about 145 Hv. If, as described above, the bump 7 is formed from two types of portion having different hardness values, the reliability of the bump 7 decreases. Accordingly, it is desirable to perform the annealing process. However, if, in this example, an annealing process is performed at 100° C. for 1 hour, the hardness of the bump 7 formed using a current density of about 1.2 A/dm$^2$ rapidly decreases to about 50 Hv. In contrast, the hardness of the bump 7 formed using a current density of about 0.6 A/dm$^2$ negligibly changes from about 120 Hv. As described above, if an annealing process is simply performed, the large difference in hardness may remain unchanged. In this example, if an annealing process is further performed at 150° C. for 1 hour, each of the hardness values is stably set to about 50 Hv. That is, according to the present exemplary embodiment, it is desirable to perform an annealing process so that the difference in hardness between a portion of the bump 7 in the interconnecting wire connection area and a portion of the bump 7 in the protrusion forming area is less than or equal to 10 Hv. Since it is desirable that the difference be ideally zero, it is desirable that the difference be greater than or equal to 0 Hv. It is more desirable that the annealing process be performed so that each of the hardness values is lower than or equal to 70 Hv. In addition, since the annealing process causes recrystallization at the interface between the interconnecting wire connection area and the protrusion forming area, the interconnecting wire connection area is coupled with the protrusion forming area. In this manner, impurities existing at the interface can be removed. Accordingly, for such a reason, it is also desirable to perform the annealing process.

It is desirable that the annealing process be performed so that the above-described hardness values are obtained. For example, it is desirable that the annealing process be performed at 200° C. to 300° C. for 30 to 120 minutes. In many cases, a process of baking, for example, an ejection port forming member is performed in a subsequent step of manufacturing a liquid ejection head. Accordingly, in order to avoid generation of impurities in the process, it is desirable that the annealing process be performed at a heating temperature that is higher than the temperature used for baking the ejection port forming member.

Figure 4L:
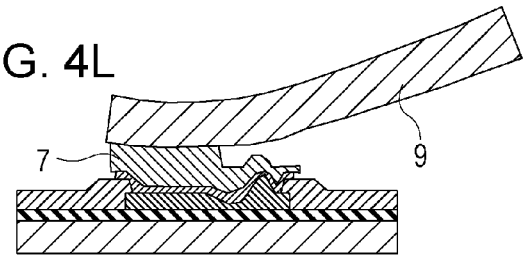

Finally, as illustrated in FIG. 4L, the interconnecting wire 9 is connected to the second surface of the bump 7. Thus, the print element board is electrically connected to the electric wiring board using the interconnecting wire 9. That is, the energy generating device 15 of the print element board is electrically connected to the electric wiring board using the interconnecting wire 9.

Note that in the step illustrated in FIG. 4E, the resist 17 may be opened so that the interconnecting wire connection area and the protrusion forming area are exposed at the same time. In such a case, in the subsequent first plating, plating metal of about 1 μm is applied. After the resist is removed, a resist is applied again. Thereafter, the resist is exposed to light and is developed. In this manner, plating is additionally performed in the interconnecting wire connection area. Even in such a method, the liquid ejection head according to the present exemplary embodiment can be manufactured. However, in this case, a resist needs to be used several times. In addition, if a proximity-type exposure machine is used in the second exposure, it is difficult to maintain accurate alignment in exposure.

As described above, the liquid ejection head according to the present exemplary embodiment can be manufactured.

According to the present exemplary embodiment, the reliability of a liquid ejection head can be increased even when the liquid ejection head includes a print element board with a bump having a protrusion formed thereon and an interconnecting wire connected to the bump.

While the present disclosure has been described with reference to exemplary embodiments, it is to be understood that the disclosed exemplary embodiments are not limiting. The scope of the following claims is to be accorded the broadest interpretation so as to encompass all such modifications and equivalent structures and functions.

This application claims the benefit of Japanese Patent Application No. 2012-173756 filed Aug. 6, 2012, which is hereby incorporated by reference herein in its entirety.

What is claimed is:

1. A liquid ejection head comprising:

a print element board including a base plate, an energy generating device configured to generate energy for ejecting liquid, an electrode pad electrically connected to the energy generating device, and a bump formed on the electrode pad; and an electric wiring board electrically connected to the bump of the print element board using an interconnecting wire, wherein the bump has a first surface, a second surface and a third surface, the third surface is opposed to the base plate, and the first surface and the second surface are provided on an opposite side of the third surface, wherein a height of the second surface from a surface of the base plate is higher than that of the first surface, wherein the first surface has a first protrusion formed therein and protruding from the bump toward the interconnecting wire, and the bump is connected to the interconnecting wire in the second surface, and wherein the height of the second surface from the surface of the base plate is higher than that of a to of the first protrusion from the surface of the base plate.

2. The liquid ejection head according to claim 1, wherein a second protrusion is formed on a surface of the electrode pad at a position corresponding to the first protrusion formed in the first surface.

3. The liquid ejection head according to claim 1, wherein the bump is formed by plating.

4. The liquid ejection head according to claim 3, wherein the plating is gold plating.

5. The liquid ejection head according to claim 2, wherein the protrusion which is formed on the surface of the electrode pad is formed by sticking a pin structure into the electrode pad.

6. The liquid ejection head according to claim 5, wherein the pin structure is a probe pin.

7. The liquid ejection head according to claim 5, wherein the protrusion which is formed on the surface of the electrode pad is formed by sticking a pin structure into the electrode pad in order to inspect electrical connection with the energy generating device.

* * * * *